US009057975B2

(12) United States Patent
Nihei et al.

(10) Patent No.: US 9,057,975 B2
(45) Date of Patent: Jun. 16, 2015

(54) IMAGE FORMING APPARATUS WITH MULTIPLE LIGHT SOURCES TIMING CONTROL

(71) Applicant: CANON KABUSHIKI KAISHA, Tokyo (JP)

(72) Inventors: Hironobu Nihei, Yokohama (JP); Takayuki Mizuta, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/103,001

(22) Filed: Dec. 11, 2013

(65) Prior Publication Data

US 2014/0168340 A1 Jun. 19, 2014

(30) Foreign Application Priority Data

Dec. 13, 2012 (JP) ..... 2012-272832
Dec. 5, 2013 (JP) ..... 2013-251891

(51) Int. Cl.

*B41J 2/435* (2006.01)
*B41J 2/47* (2006.01)
*G03G 15/043* (2006.01)
*G03G 21/14* (2006.01)

(52) U.S. Cl.

CPC ..... *G03G 15/043* (2013.01); *G03G 21/14* (2013.01)

(58) Field of Classification Search

CPC ..... G03G 15/043; G03G 15/1605; G03G 15/5054; G03G 15/00012; G03G 15/0103
USPC ..... 347/116, 229, 234, 235, 248–250
See application file for complete search history.

(56) References Cited

U.S. PATENT DOCUMENTS

| | | | | |
|---|---|---|---|---|
| 7,149,018 | B2 | 12/2006 | Yoshikawa et al. | |
| 7,719,558 | B1 | 5/2010 | Unruh et al. | |
| 2004/0037584 | A1 * | 2/2004 | Takahashi et al. | 399/100 |
| 2013/0169731 | A1 | 7/2013 | Mizuta et al. | |

FOREIGN PATENT DOCUMENTS

| | | | |
|---|---|---|---|
| EP | 1 392 049 | A2 | 2/2004 |
| JP | 04-313776 | A | 11/1992 |
| JP | 2003-191525 | A | 7/2003 |
| JP | 2003-200609 | A | 7/2003 |
| JP | 2006-146177 | A | 6/2006 |
| JP | 2006-251403 | A | 9/2006 |

OTHER PUBLICATIONS

Search Report in European Patent Application No. 13195279.8, dated Apr. 15, 2014.

* cited by examiner

*Primary Examiner* — Hai C Pham
(74) *Attorney, Agent, or Firm* — Fitzpatrick, Cella, Harper & Scinto

(57) ABSTRACT

An image forming apparatus includes first and second photosensitive members; first and second light sources; a rotatable polygonal mirror; a first signal output portion; and a second signal output portion. The first light source emits the light at timing on the basis of the first signal, and the second light source emits the light at timing on the basis of the second signal so that latent images are formed on the first and second photosensitive members, respectively, and then are developed with developers to form developer images on the first and second photosensitive members, respectively, and then an image is formed by superposing the developer images. Before output of a second signal from the second signal output portion is started, the first light source emits the light on the basis of a first signal to start formation of the latent image on the first photosensitive member.

11 Claims, 12 Drawing Sheets

IMAGE FORMING APPARATUS WITH MULTIPLE LIGHT SOURCES TIMING CONTROL

FIELD OF THE INVENTION AND RELATED ART

The present invention relates to an image forming apparatus, such as a copying machine or a printer, having a function of forming an image on a recording material such as a sheet.

In a conventional image forming apparatus of an electrophotographic type, a laser beam modulated by an image signal is reflected by a rotational polygonal mirror provided in a scanner to scan a surface of a photosensitive member, thus effecting image formation. As the photosensitive member, a drum shaped photosensitive member is frequently used and is called a photosensitive drum. In the case where this type is applied to a color laser printer, an image of four colors of yellow (Y), magenta (M), cyan (C) and black (BK) are superposed to form a color image on a sheet.

Here, in Japanese Laid-Open Patent Application (JP-A) 2003-200609, a constitution for synchronizing image writing timing in the case where the number of BD (beam detect) sensors is decreased in an image forming apparatus in which a plurality of photosensitive members are simultaneously scanned with laser beams by using a single polygonal mirror is disclosed. In this constitution, with respect to the laser beam for which a corresponding BD sensor is not provided, the image writing timing is synchronized by using a pseudo BD side as described below. That is, by calculating an amount of delay of a horizontal synchronizing signal with respect to each side of the polygonal mirror in anticipation of a side division error in each mirror side of the polygonal mirror, the pseudo BD signal is generated from a BD signal, and then the image writing timing is synchronized by using the pseudo BD signal.

However, the image forming apparatus described in JP-A 2003-200609 involves the following problem.

In JP-A 2003-200609, the pseudo BD signal was generated from the BD signal by calculating the amount of delay of the horizontal synchronizing signal with respect to each side of the polygonal mirror in anticipation of the side division error of the polygonal mirror. In this case, image formation was started after completion of the calculation of this amount of delay.

For this reason, there is a fear that a first print out time becomes long.

SUMMARY OF THE INVENTION

A principal object of the present invention is to provide an image forming apparatus capable of reducing a first print out time in a constitution in which light is emitted from a light source at timing on the basis of a pseudo BD signal generated on the basis of a BD signal to form a latent image.

According to an aspect of the present invention, there is provided an image forming apparatus comprising: first and second photosensitive members; first and second light sources each for emitting light; a rotatable polygonal mirror for deflecting the light, emitted from the first light source, toward the first photosensitive member and for deflecting the light, emitted from the second light source, toward the second photosensitive member; first signal output means for outputting a first signal by detecting, in a predetermined position, the light emitted from the first light source and deflected by the rotatable polygonal mirror; and second signal output means for outputting a second signal different from the first signal on the basis of the first signal, wherein the first light source emits the light at timing on the basis of the first signal and the second light source emits the light at timing on the basis of the second signal so that latent images are formed on the first and second photosensitive members, respectively, and then are developed with developers to form developer images on the first and second photosensitive members, respectively, and then an image is formed by superposing the developer images, and wherein before output of the second signal from the second signal output means is started, the first light source emits the light on the basis of the first signal to start formation of the latent image on the first photosensitive member.

These and other objects, features and advantages of the present invention will become more apparent upon a consideration of the following description of the preferred embodiments of the present invention taken in conjunction with the accompanying drawings.

Figure 6:
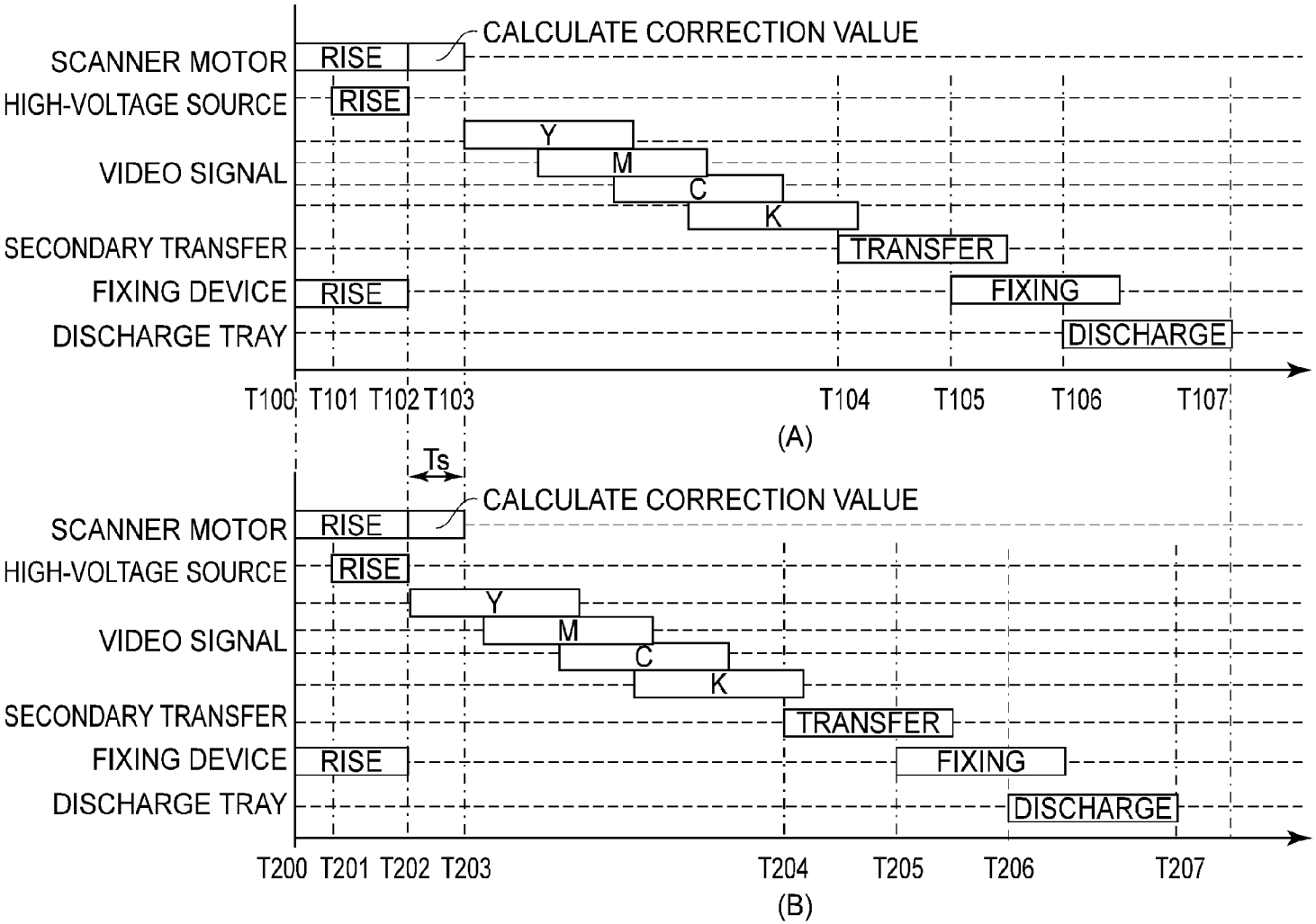

Parts (A) and (B) of FIG. 6 are timing charts each for illustrating a feature of Embodiment 1.

Figure 7:
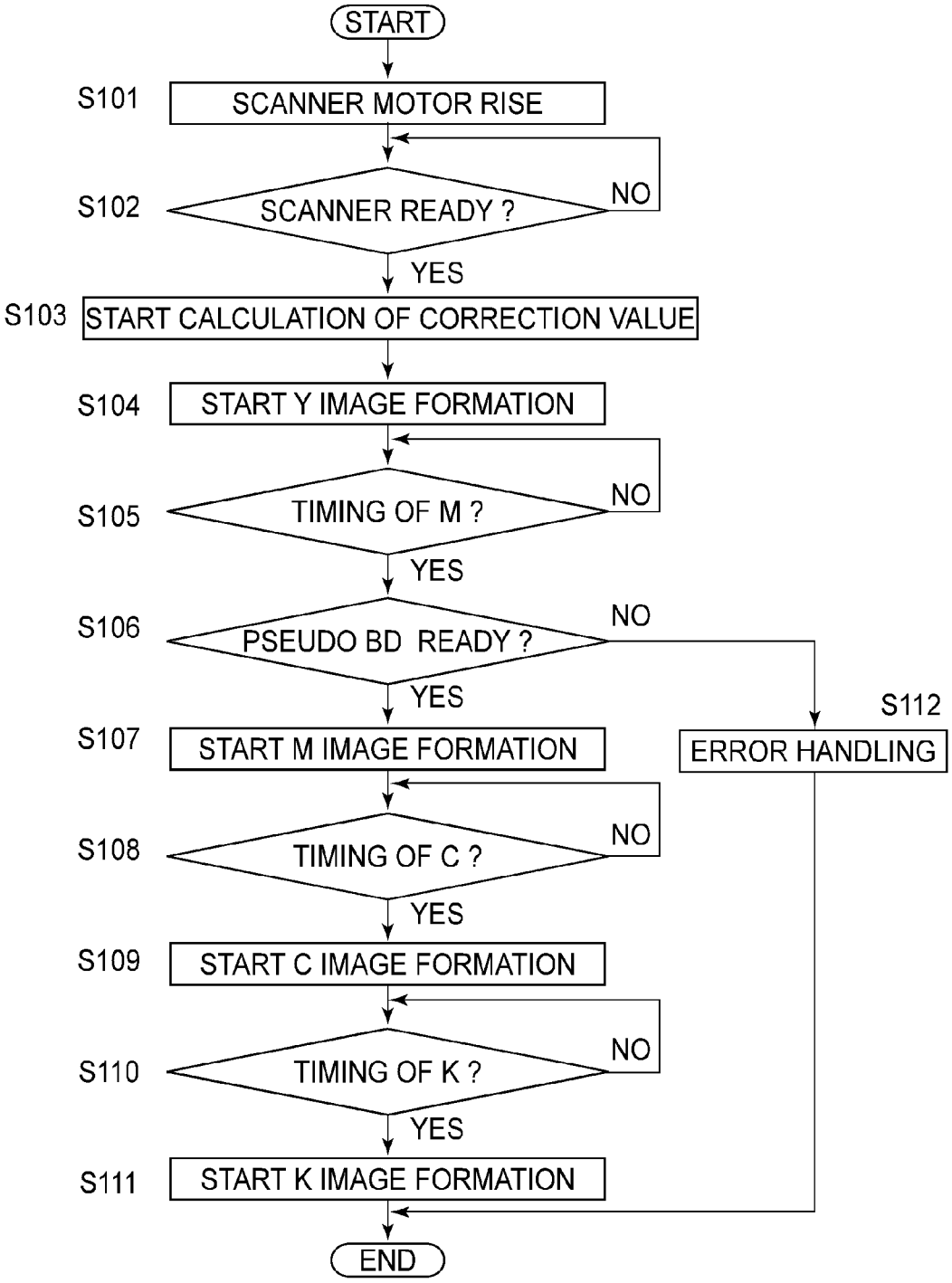

FIG. 7 is a flowchart showing an operation executed by an engine controller in Embodiment 1.

Figure 8:
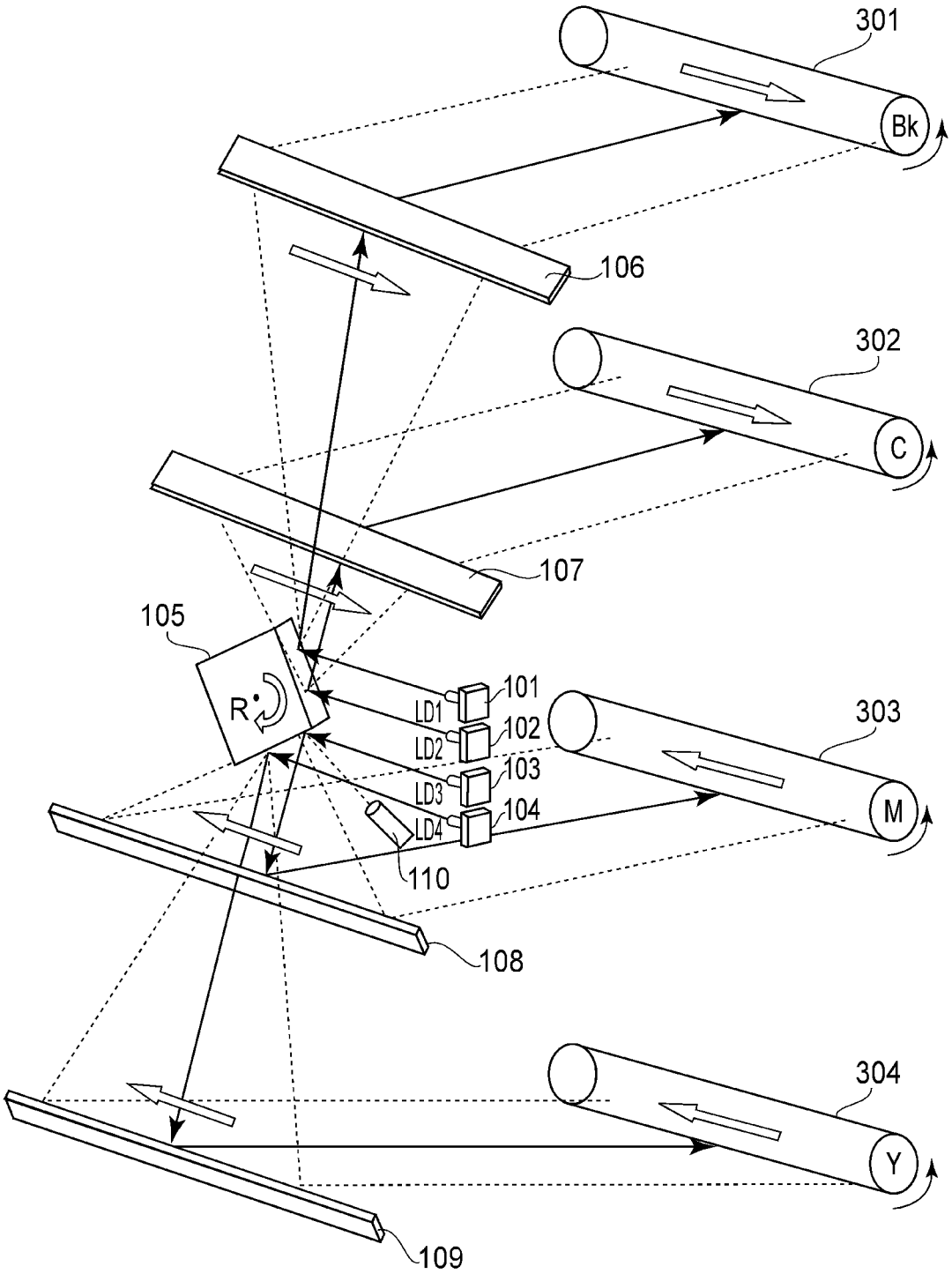

FIG. 8 is a schematic perspective view for illustrating a scanner unit in Embodiment 2.

Figure 9:
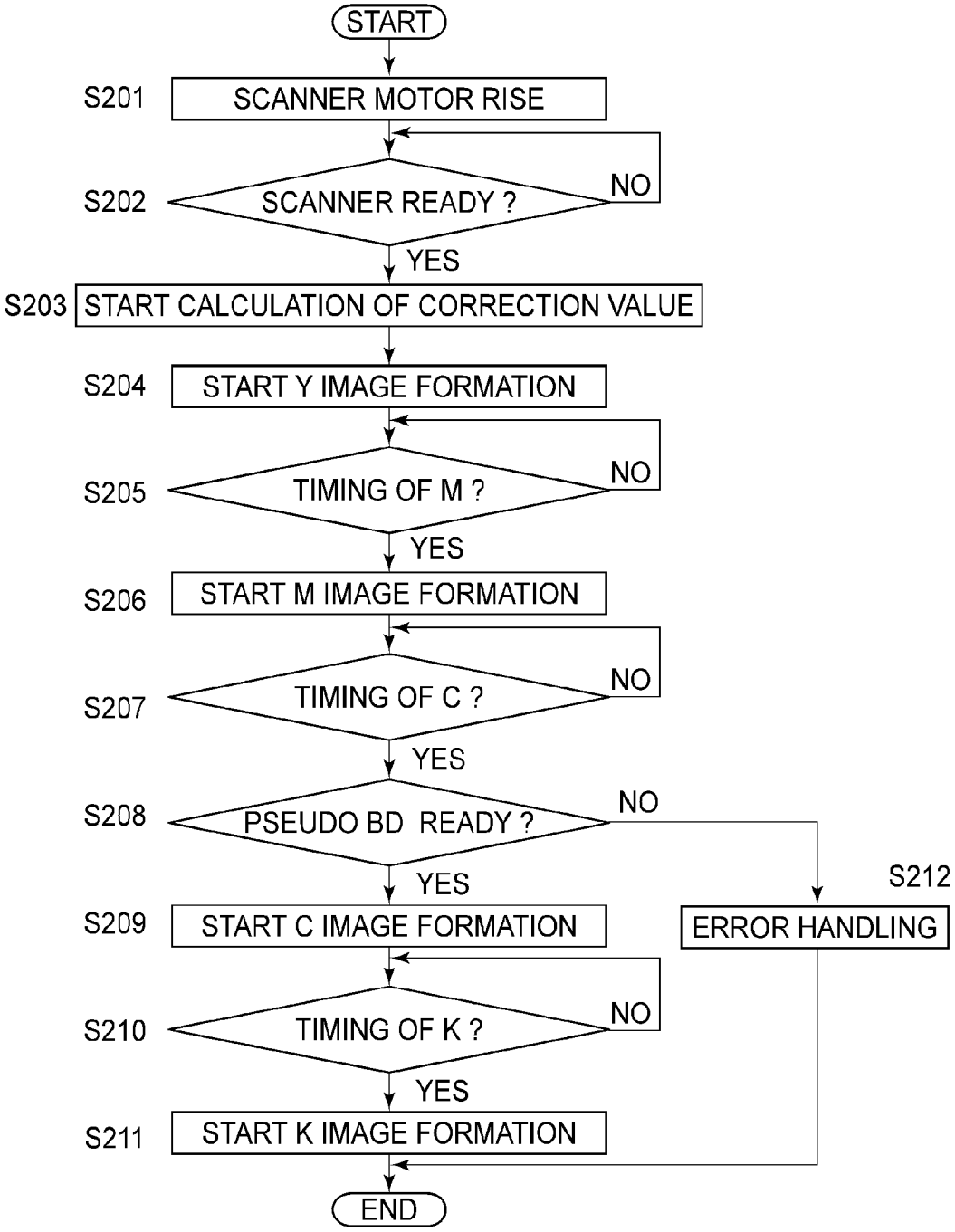

FIG. 9 is a flowchart showing an operation executed by an engine controller in Embodiment 2.

Figure 10:
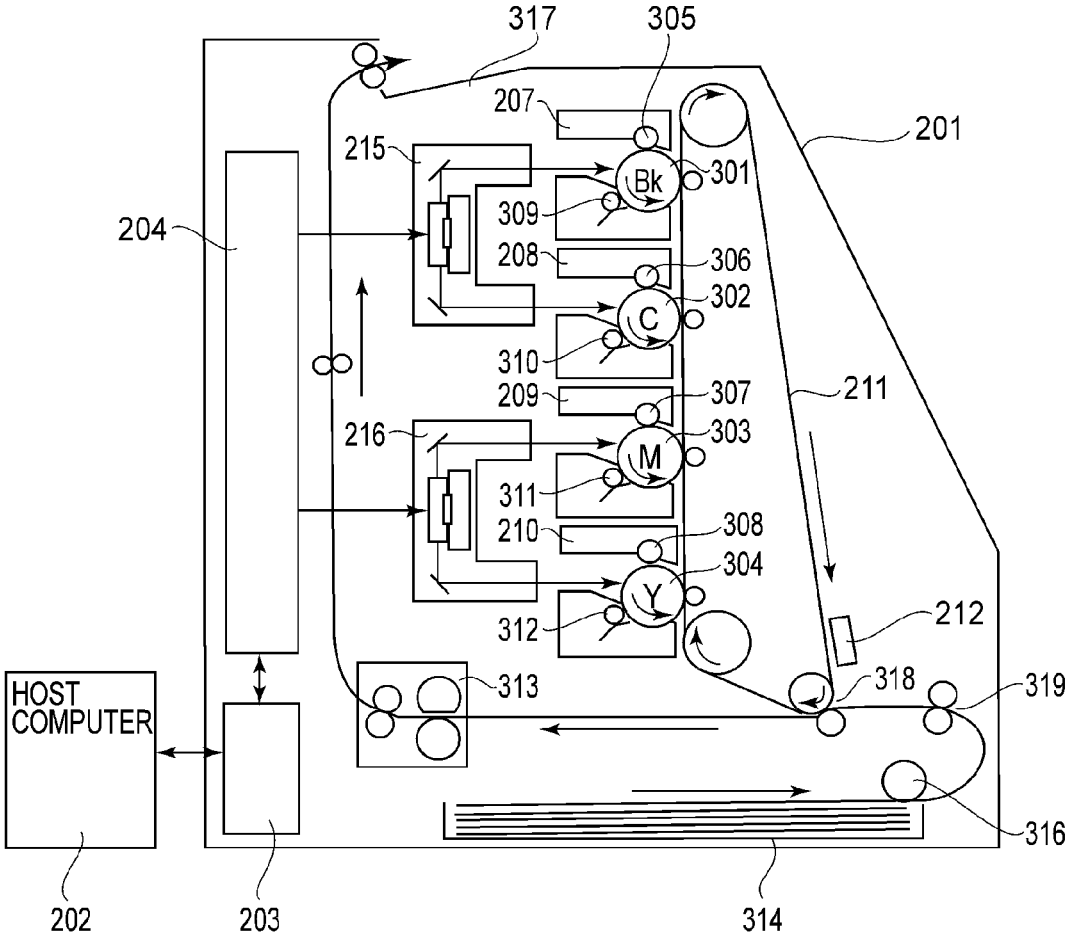

FIG. 10 is a sectional view showing a general structure of an image forming apparatus in Embodiment 3.

Figure 11:
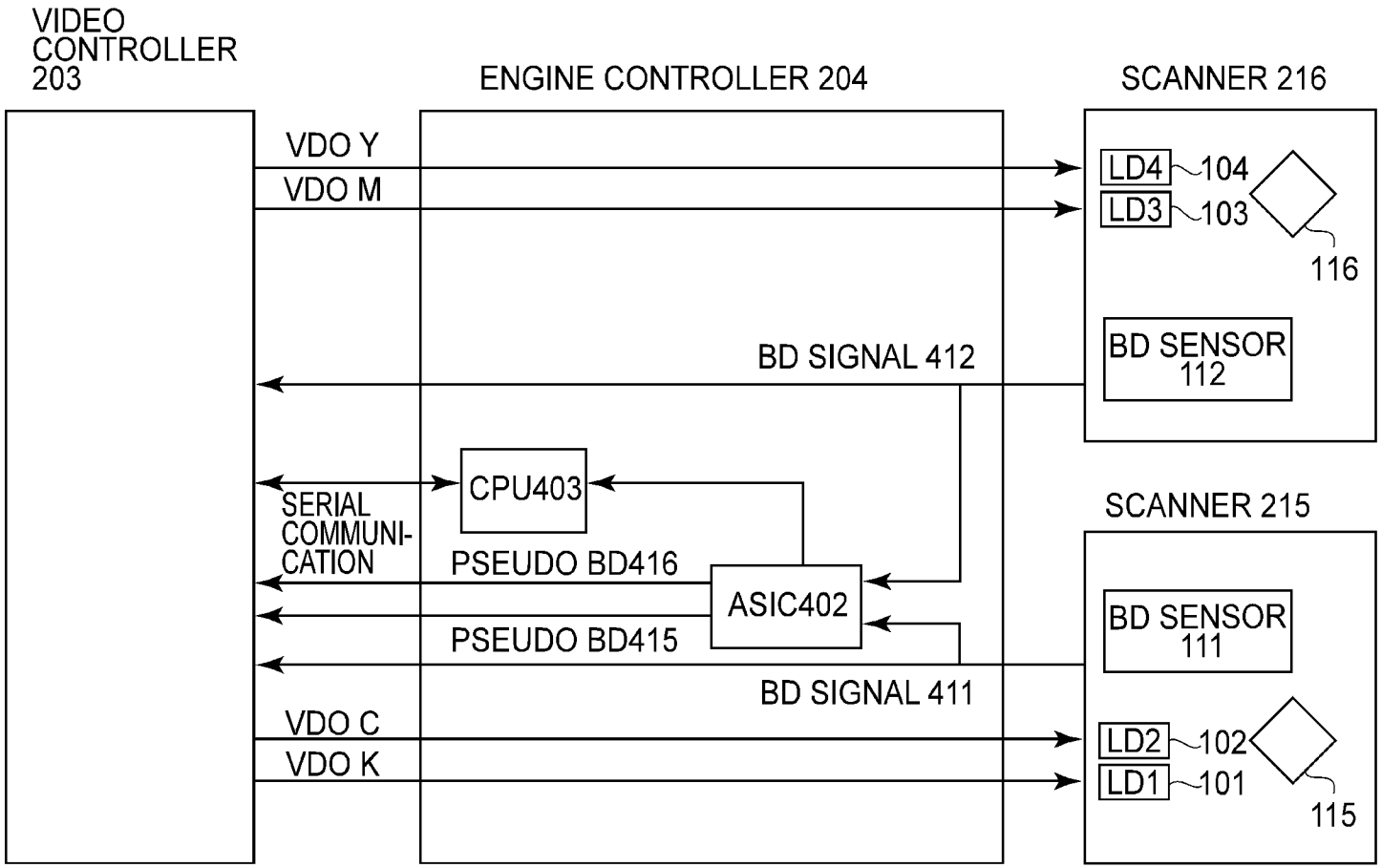

FIG. 11 is a block diagram for illustrating a generating method of a pseudo BD signal in Embodiment 3.

Figure 12:
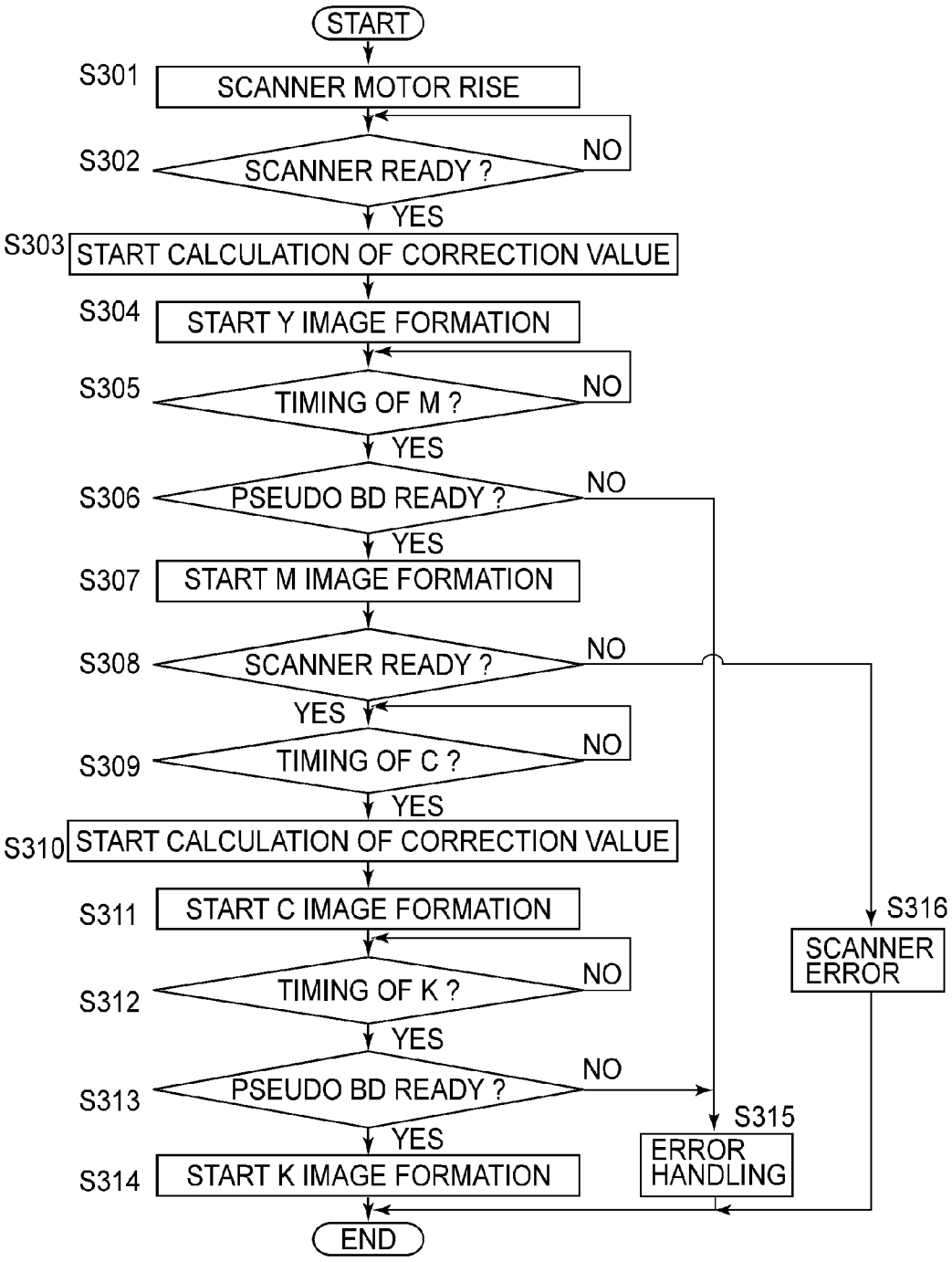

FIG. 12 is a flowchart showing an operation executed by an engine controller in Embodiment 3.

DESCRIPTION OF THE PREFERRED EMBODIMENTS

With reference to the drawings, embodiments for carrying out the present invention will be specifically described. However, dimensions, materials, shapes and relative arrangements of constituent elements described in the following embodiments should be appropriately modified depending on constitutions and various conditions of a device (apparatus) to which the present invention is applied. That is, the scope of the present invention is not limited to the following embodiments. The present invention relates to an image forming apparatus using an electrophotographic process, and particularly relates to a color image forming apparatus for forming different color images by using a plurality of laser beams.

Embodiment 1

Figure 1:
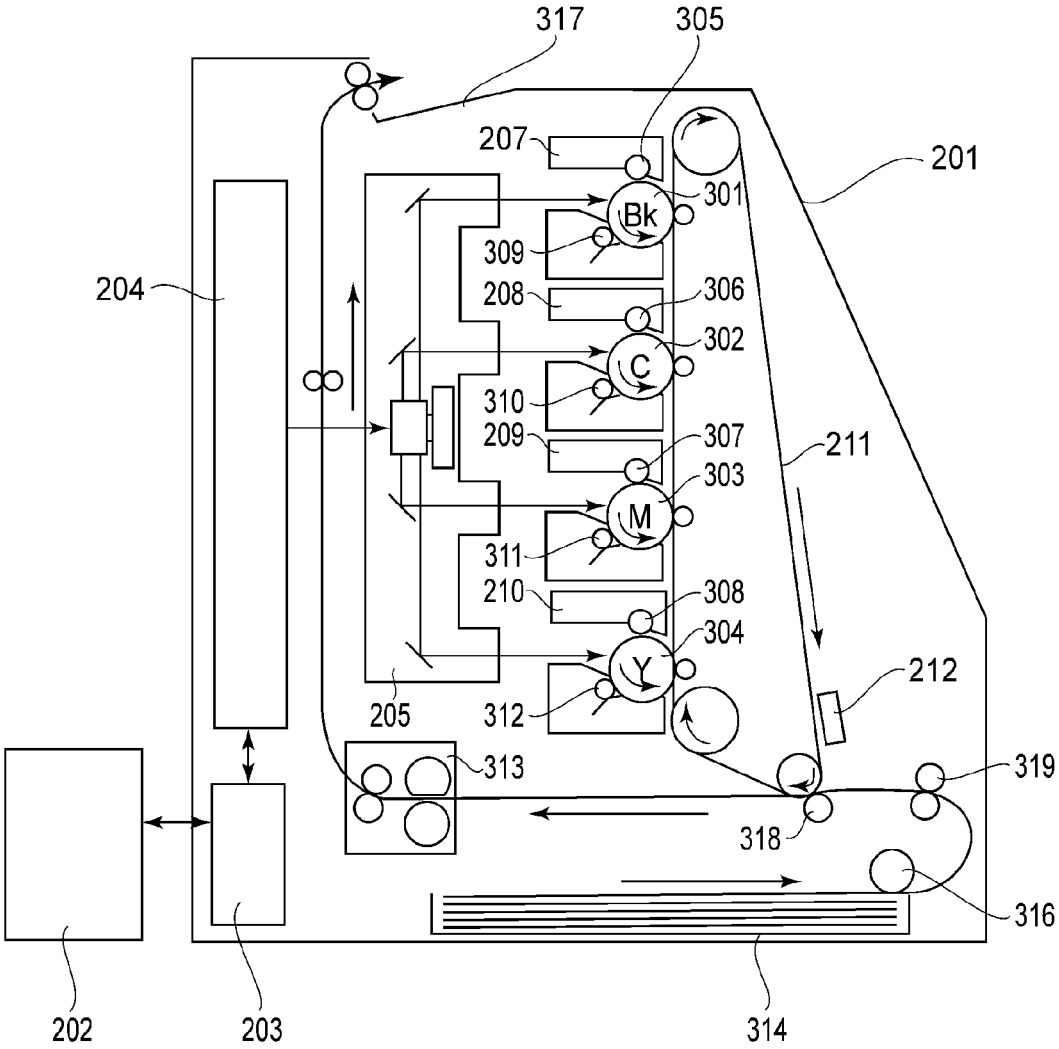
FIG. 1 is a sectional view showing a general structure of an image forming apparatus in Embodiment 1.

Embodiment 1 of the present invention will be described. FIG. 1 is a sectional view showing a schematic structure of a color laser (beam) printer 201 as an image forming apparatus in this embodiment.

The printer 201 is connected with a host computer 202. The printer 201 includes four color image forming portions for forming a color image obtained by superposing images of four colors of yellow (Y), magenta (M), cyan (C) and black (BK). The image forming portions include toner cartridges 207 to 210 including photosensitive drums 301 to 304 as an image bearing member, and a scanner unit 205 including laser diodes, as a light source for image exposure, for generating light (laser beams). The scanner unit 205 will be described specifically later.

When the printer 201 receives image data from the host computer 202, a video controller 203 in the printer 201 develops the image data into desired video signal forming data (e.g., bit-mapped data) to generate video signals for image formation. The video controller 203 and the engine controller 204 carry out serial communication, thus effecting transmission and reception of information. The video signals are sent to the engine controller 204, and then the engine controller 204 drives laser diodes (not shown) in the scanner unit 205 on the basis of the video signals. As a result, electrostatic latent images (latent images) are formed on the photosensitive drums 301 to 304 in the toner cartridges 207 to 210, respectively.

The photosensitive drums 301 to 304 are used for forming the electrostatic latent images for black, cyan, magenta and yellow, respectively.

In the toner cartridges 207 to 210, the electrostatic latent images formed on the photosensitive drums 301 to 304 are visualized (developed) by using toners (developers), so that color toner images are formed on the photosensitive drums 301 to 304. Of the respective color toner images formed on the photosensitive drums (image bearing members), the toner image of yellow (first color) is first transferred onto an intermediary transfer belt (belt) 211, and then the toner images of magenta, cyan and black are successively transferred superposedly in the stated order on the belt (primary transfer). As a result, a color image is formed on the intermediary transfer belt 211. Here, in the toner cartridges 207 to 210, developing devices 309 to 312 and cleaning devices 305 to 308 are provided. Here, the photosensitive drums 304 and 302 correspond to first and second image bearing members, respectively. Further, with respect to a movement direction of a surface of the intermediary transfer belt 211, a contact portion between the photosensitive drum 304 and the intermediary transfer belt 211 is disposed upstream of a contact portion between the photosensitive drum 302 and the intermediary transfer belt 211.

Further, a recording material in a cassette 314 is fed to a registration roller 319 by a feeding roller 316, and then is conveyed, at driving timing of the registration roller 319, in synchronism with the color image on the intermediary transfer belt 211. Then, the color image is transferred from the intermediary transfer belt 211 onto the recording material by a transfer roller 318 (secondary transfer). The recording material on which the image is transferred is conveyed into a fixing device 313, and then the image is fixed on the recording material under heat and pressure by the fixing device 313. Thereafter, the recording material on which the image is fixed is discharged onto a discharge tray 317 at an upper portion of the printer 201.

Further, the printer 201 is provided with a registration detecting sensor 212 for monitoring a registration position of the image on the intermediary transfer belt 211. This sensor 212 reads a position of each of the color images, formed on the intermediary transfer belt 211, at desired timing other than during image formation, and then feeds back the read data to the video controller 203 or the engine controller 204. As a result, the registration position of each of the color toner images is adjusted, so that it is possible to prevent color misregistration.

Figure 2:
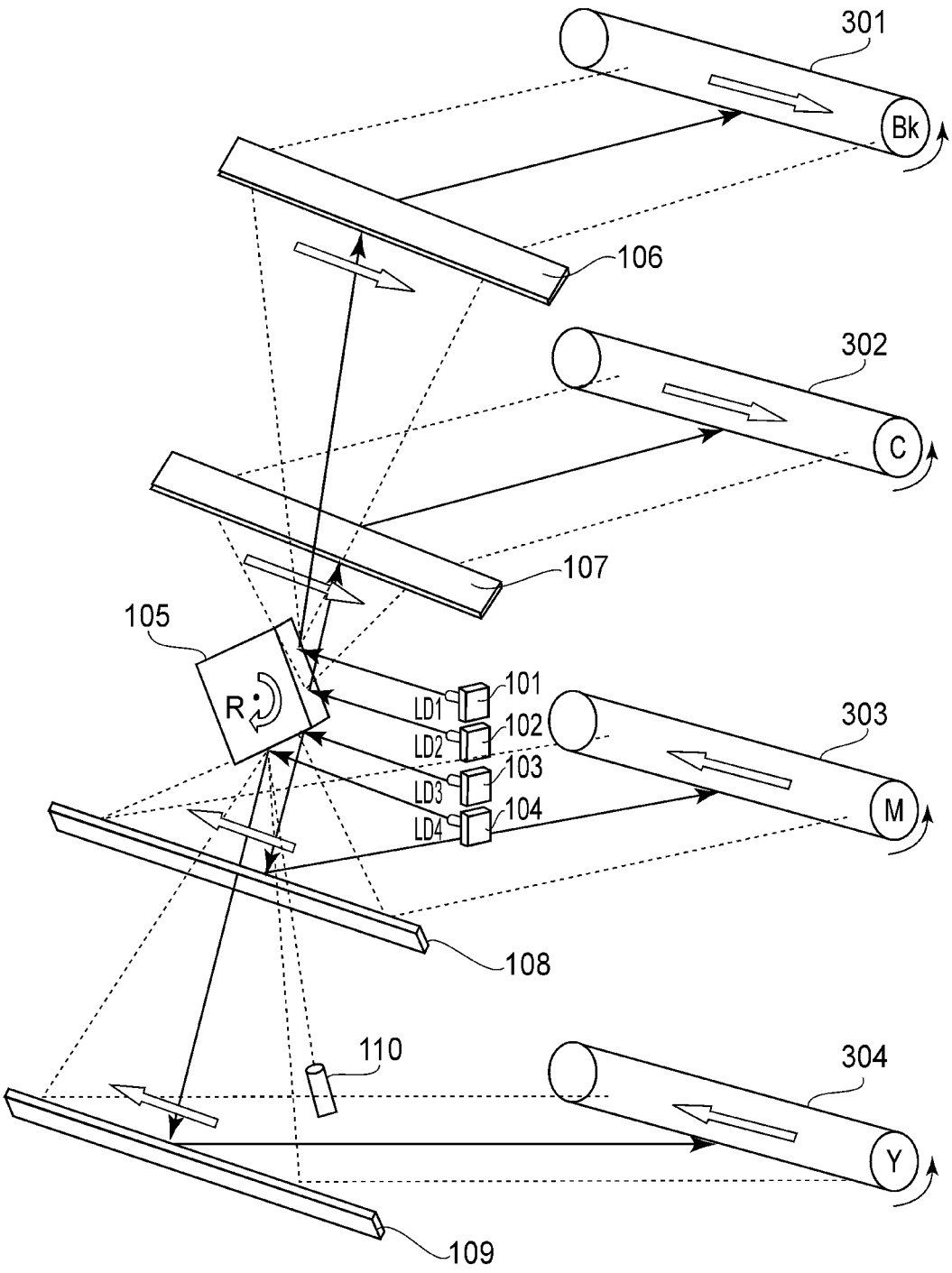
FIG. 2 is a schematic perspective view for illustrating a scanner unit in Embodiment 1.

FIG. 2 is a schematic perspective view for specifically illustrating the scanner unit 205 shown in FIG. 1. In FIG. 2, reference numerals 101, 102, 103 and 104 represent laser diodes, and on the basis of the video signal generated by the video controller 203, the surfaces of the photosensitive drums 301, 302, 303 and 304 are scanned with laser beams (light beams) emitted from the laser diodes 101, 102, 103 and 104, respectively. In the following description, for convenience, the laser diodes 101, 102, 103 and 104 are referred to as laser diodes LD1, LD2, LD3 and LD4, respectively. Here, the laser diodes LD4 and LD2 correspond to first and second light sources, respectively.

A polygonal mirror 105 as a rotational polygonal mirror is rotated in an arrow R direction in FIG. 2 by an unshown motor and is used for subjecting the light beams from the laser diodes LD1, LD2, LD3 and LD4 to deflection scanning. The motor for driving the polygonal mirror 105 is controlled so as to be rotated at a certain speed by an acceleration signal and a reduced speed signal of an unshown control signal from the engine controller 204.

A BD sensor 110 is an optical sensor provided in a predetermined position where the light (beam) which is emitted from the laser diode LD4 and which is then reflected by the polygonal mirror 105 in a predetermined direction enters. The BD sensor 110 receives (detects) the light from the laser diode LD4 (first light source) and outputs a horizontal synchronizing signal (BD (beam detect) signal) on the basis of the light. The horizontal synchronizing signal (first horizontal synchronizing signal) outputted from the BD sensor is a signal as a reference (basis) of timing of light emission of the laser diode LD4 for forming the electrostatic latent image on the photosensitive drum 304 (first image bearing member). Specifically, a writing position (emission start position of the laser diode for each reflection side) of a scanning line corresponding to an associated reflection side when the scanning line is formed by reflecting the light beam from the laser diode at the reflection side of the rotating polygonal mirror 105 and then by moving a beam spot on the photosensitive member in a main scan image is determined on the basis of the horizontal synchronizing signal. The BD sensor 110 corresponds to a first signal output means for outputting the first horizontal synchronizing signal.

The light emitted from the laser diode LD4 is used for scanning by the rotation of the polygonal mirror 105 while being reflected by the polygonal mirror 105, and then is further reflected by a folding mirror 109, so that the photosensitive drum 304 is illuminated with the light. As a result, the electrostatic latent image is formed on the photosensitive drum 304.

Incidentally, in actuality, the light passes through unshown various lens groups in order to be focused on the photosensitive drum or in order to be converted from diffused light into parallel light.

The timing when the BD sensor 110 outputs the signal is timing when an incident angle of the light emitted from the laser diode LD4 is a predetermined angle irrespective of whether the light is incident on which reflection side of the polygonal mirror 105. Accordingly, usually, the video controller 203 sends the video signals to the engine controller 204 after a predetermined time from detection of an output signal of the BD sensor 110 is counted. As a result, a main scanning writing position of the image by the light on the photosensitive drum can be determined in an arbitrary position irrespective of whether the light emitted from the laser diode LD4 is incident on which reflection side of the polygonal mirror 105, so that writing positions of the respective scanning lines can be always made coincide with each other.

On the other hand, also with respect to the laser diodes LD1, LD2 and LD3, similarly as in the laser diode 4, the electrostatic latent images are formed on the photosensitive drums 301, 302 and 303, respectively.

Here, the BD sensor 110 is provided only in the position where the light emitted from the laser diode LD4 enters, so that there is no BD sensor on scanning passages of the laser diodes LD1, LD2 and LD3. The light from the laser diode LD3 and the light from the laser diode LD4 are incident on the same side of the polygonal mirror 105 at the same timing. For this reason, as a horizontal synchronizing signal as a reference of (light) emission timing of the laser diode LD3 for forming the electrostatic latent image on the photosensitive drum 303, the above-described first horizontal synchronizing signal (first signal) generated by the light from the laser diode LD4, i.e., the BD signal outputted from the BD sensor 110 can be used. On the other hand, the light from the laser diode LD1 and the light from the laser diode LD2 are incident on a side different from the side, of the polygonal mirror 105, where the light from the laser diode LD4 is incident on the polygonal mirror 105 at the same timing, so that associated photosensitive drums are illuminated therewith, respectively. That is, at the timing when the photosensitive drums 301 and 302 are illuminated with the light from the laser diode LD1 and the light from the laser diode LD2 and when the photosensitive drums 303 and 304 are illuminated with the light from the laser diode LD3 and the light from the laser diode LD4, the side of the polygonal mirror 105 on which the light from the laser diode LD1 and the light from the laser diode LD2 are incident and the side of the polygonal mirror 105 on which the light from the laser diode LD3 and the light from the laser diode LD4 are incident are different from each other.

Here, the polygonal mirror 105 causes an error (side division error) due to molding accuracy of the reflection sides. For this reason, at the timing when the BD sensor 110 outputs the signal, there is a variation, for each of the reflection sides, in angle of the reflection side of the polygonal mirror 105 on which the light from the laser diode LD1 and the light from the laser diode LD2 are incident. For this reason, even when the side of the polygonal mirror 105 on which the light from the laser diode LD1 and the light from the laser diode LD2 are incident is which reflection side, another horizontal synchronizing signal to be outputted at timing when the reflection side provides a predetermined angle is needed.

For this reason, in this embodiment, a BD signal (second horizontal synchronizing signal or second signal) for the laser diodes LD1 and LD2 (second light source) is generated by ASIC 402. The horizontal synchronizing signal (second horizontal synchronizing signal) generated by the ASIC 402 is a pseudo horizontal synchronizing signal (pseudo BD signal) providing a reference of timing when the laser diodes LD1 and LD2 emit the light beams in order to form the electrostatic latent images on the photosensitive drums 301 and 302 (second image bearing member). The pseudo BD signal is generated by correcting the first horizontal synchronizing signal.

In this embodiment, the light beams emitted from the laser diodes LD1 and LD2 are incident on the same side of the polygonal mirror 105 at the same timing, and therefore the pseudo BD signal can be made common to the laser diodes LD1 and LD2. In the following, description will be made on assumption that the ASIC 402 generates the pseudo BD signal for the laser diode LD2. Here, the laser diode LD2 corresponds to the second light source different in electrostatic latent image formation start timing from the laser diode LD4 (first light source).

As described above, the color image of yellow (Y) is formed on the photosensitive drum 304 by the laser diode LD4 provided with the BD sensor 110. Further, the color images of black (BK), cyan (C) and magenta (M) are formed on the photosensitive drums 301, 302 and 303 by the laser diodes LD1, LD2 and LD3, respectively, provided with no BD sensor 110. As a result, the image formation is effected. A series of image forming process operations is as described above.

Figure 3:
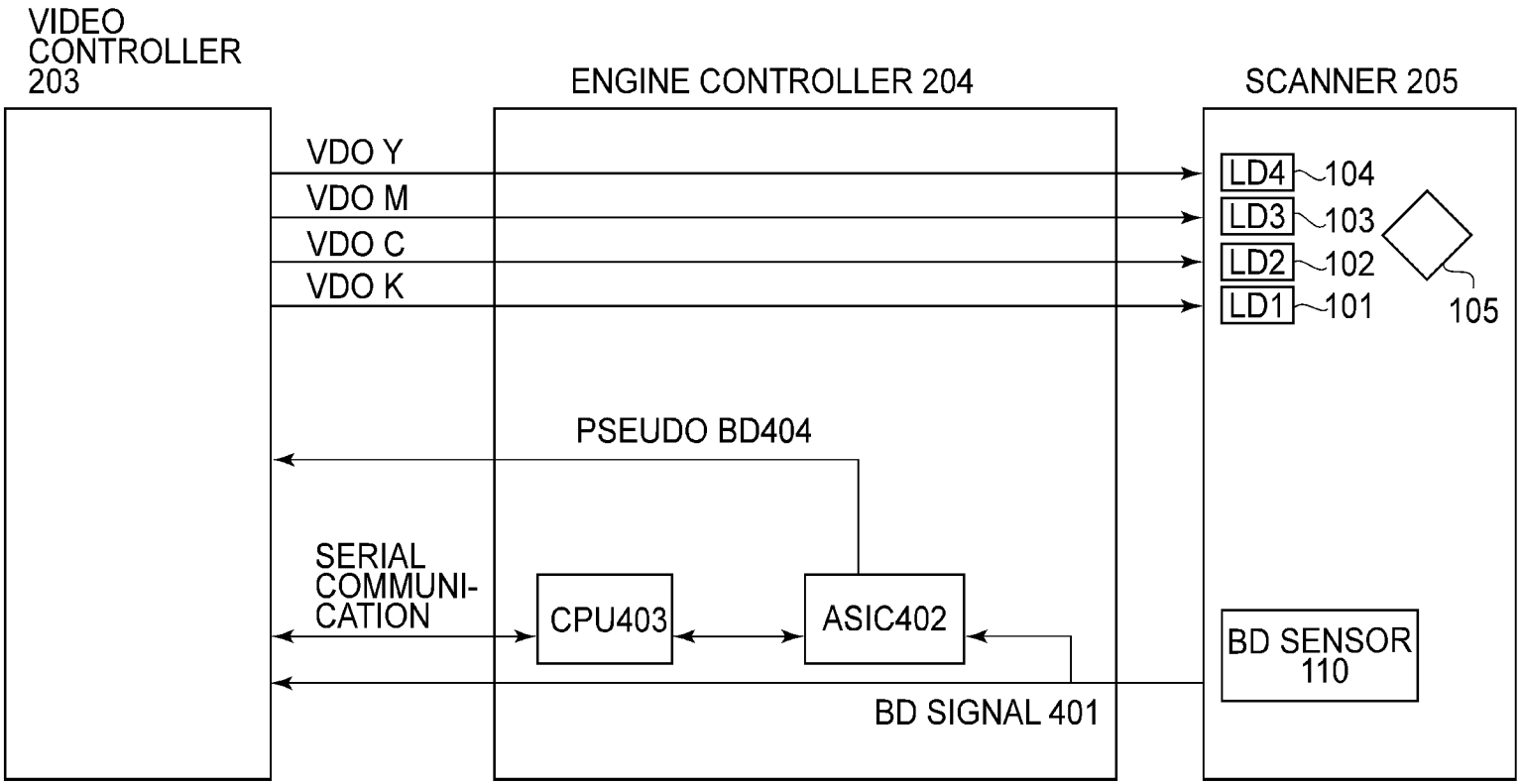
FIG. 3 is a block diagram for illustrating a generating method of a pseudo BD signal in Embodiment 1.

Next, a generating method of the pseudo BD signal will be described with reference to a block diagram of FIG. 3.

Inside the engine controller 204, the ASIC 402 and CPU 403 are provided and are connected by an address data bus. The ASIC 402 includes a circuit for generating the pseudo BD signal.

First, a BD signal 401 as the horizontal synchronizing signal from the BD sensor 110 is inputted into the ASIC 402, provided in the engine controller 204, and the video controller 203. The ASIC 402 receives the BD signal 401 and calculates a BD period described later, and then sends a value of the calculated BD period to the CPU 403. The CPU 403 corrects the BD signal 401 from the value of the BD period to calculate (derive) a correction value for generating the pseudo BD signal, and then inputs the correction value into the ASIC 402 through the address data bus. Then, the ASIC 402 generates (outputs) a pseudo BD signal 404 on the basis of the correction value and the BD signal 401 from the BD sensor 110. The outputted pseudo BD signal is inputted into the video controller 203. Thus, the ASIC 402 and the CPU 403 constitute a second signal output means for generating and outputting, on the basis of the BD signal 401, the BD signal (second horizontal synchronizing signal) for the laser diodes LD1 and LD2. This second output means executes a step of deriving the correction value by calculating the correction value on the basis of the BD period, and when the derivation of the correction value is completed, the second signal output means outputs the pseudo BD signal 404. Here, this correction value is a correction value, with respect to the laser diode LD2, for correcting a difference in electrostatic latent image formation start timing on the basis of the BD signal between the laser diodes LD2 and LD4. Further, in the following description, this correction value is referred to as a correction value for the pseudo BD signal is some cases for convenience of explanation.

The video controller 203 receives the BD signal 401 outputted from the BD sensor 110 and the pseudo BD signal 404 outputted from the ASIC 402. At predetermined timing from the input of the BD signal 401, image data VDOM and VDOY are outputted from the video controller 203 to the laser diodes LD3 and LD4 of the scanner unit 205. The laser diodes LD3 and LD4 emit the light on the basis of the image data VDOM and VDOY, so that the electrostatic latent images on the basis of the image data VDOM and VDOY are formed on the photosensitive drums 303 and 304. Similarly, at predetermined timing from the input of the pseudo BD signal 404, image data VDOK and VDOC are outputted from the video controller 203 to the laser diodes LD1 and LD2 of the scanner unit 205. The laser diodes LD1 and LD2 emit the light on the basis of the image data VDOK and VDOC, so that the electrostatic latent images on the basis of the image data VDOK and VDOC are formed on the photosensitive drums 301 and 302.

Next, a correction value calculating method for every 4 sides and a pseudo BD side generating method for every 4 sides will be described with reference to a timing chart shown in FIG. 4 and a relation view of the polygonal mirror 105, the laser diodes LD2 and LD4 and the BD sensor 110 shown in FIG. 5.

With respect to the polygonal mirror 105, due to the molding accuracy error (side division error), the BD period is different every side.

In this embodiment, with respect to the BD signal for each side of the polygonal mirror 105, periods (BD periods), measured by the ASIC 402, from A side to B side, from B side to C side, from C side to D side, and from D side to A side are xa, xb, xc and xd, respectively. Here, it can be said that, e.g., the BD period xa is a time (interval) from detection of the light, which is emitted from the laser diode LD4 and which is then reflected by the A side, by the BD sensor 110 to detection of the light, which is emitted from the laser diode LD4 and which is then reflected by the B side, by the BD sensor 110.

From each of the BD periods for the respective sides, a smallest BD period as these BD periods is subtracted, so that a resultant value is used as the correction value.

The reason therefor is as follows. When the BD signal uses the A side, the pseudo BD signal uses the B side, and when the BD signal uses the side B, the pseudo BD signal uses the C side. Further, when the BD signal uses the C side, the pseudo BD signal uses the D side, and when the BD signal uses the D side, the pseudo BD signal uses the A side. Then, on the basis of correspondence between the BD signal and the pseudo BD signal, the correction value is determined. Further, the correction value depends on the polygonal mirror 105 and is little changed with time, and therefore writing from the BD signal 401 is constant. Further, a reference side is determined by determining that the polygonal mirror side having the smallest BD period provides the correction value of 0.

Therefore, in the case where the smallest (shortest) BD period is xb, the correction values are determined as follows.

The correction value for the B side with respect to the pseudo BD signal associated with the A side with respect to the BD signal is represented by:

(Period of BD signal from *A* side to *B* side)−(Shortest BD period)=*xa*−*xb*.

Accordingly, the correction value is (xa−xb).

Further, the correction value for the C side with respect to the pseudo BD signal associated with the B side with respect to the BD signal is represented by:

(Period of BD signal from *B* side to *C* side)−(Shortest BD period)=*xb*−*xb*.

Accordingly, the correction value is 0.

Further, the correction value for the D side with respect to the pseudo BD signal associated with the C side with respect to the BD signal is represented by:

(Period of BD signal from *C* side to *D* side)−(Shortest BD period)=*xc*−*xb*.

Accordingly, the correction value is (xc−xb).

Further, the correction value for the A side with respect to the pseudo BD signal associated with the D side with respect to the BD signal is represented by:

(Period of BD signal from *D* side to *A* side)−(Shortest BD period)=*xd*−*xb*.

Accordingly, the correction value is (xd−xb).

With respect to the pseudo BD signal or the B side associated with the BD signal for the A side, the correction value is (xa−xb), and therefore the pseudo BD signal having the BD period which is delayed from the BD period of the BD signal by (xa−xb) is generated and outputted.

With respect to the pseudo BD signal or the C side associated with the BD signal for the B side, the correction value is 0, and therefore the BD signal itself is outputted as the pseudo BD signal.

With respect to the pseudo BD signal or the D side associated with the BD signal for the C side, the correction value is (xc−xb), and therefore the pseudo BD signal having the BD period which is delayed from the BD period of the BD signal by (xc−xb) is generated and outputted.

With respect to the pseudo BD signal or the A side associated with the BD signal for the D side, the correction value is (xd−xb), and therefore the pseudo BD signal having the BD period which is delayed from the BD period of the BD signal by (xd−xb) is generated and outputted.

In generation of the pseudo BD signal, when the BD signal is outputted, the side of the polygonal mirror 105 by which the light emitted from the laser diode LD4 is deflected is determined, so that the correction value is determined from the BD period calculated correspondingly to the determined side. In this case, the BD period is different for every side, and therefore by calculating the BD period, it is possible to specify the side of the polygonal mirror by which the light emitted from the laser diode LD4 is deflected.

Figure 4:
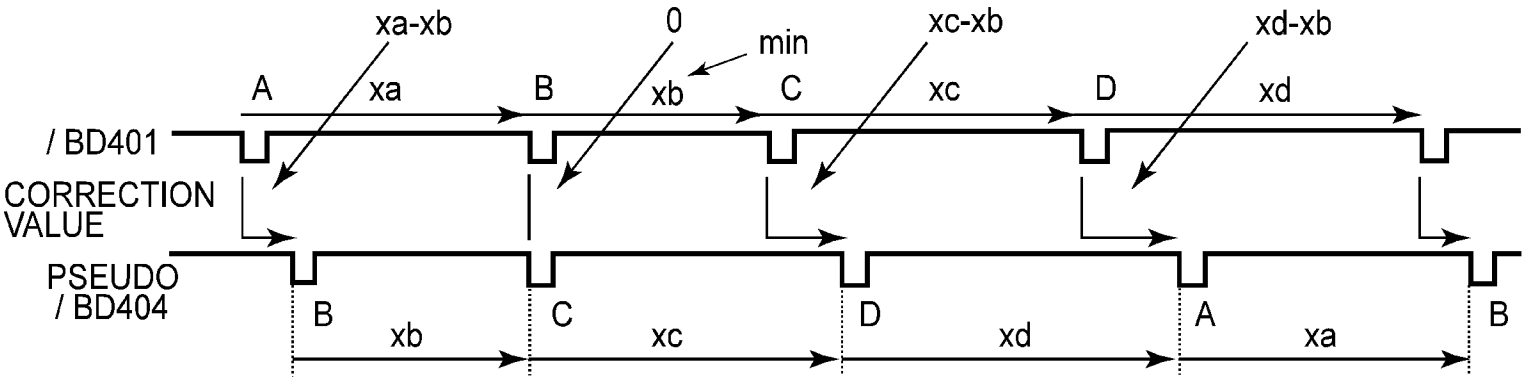
FIG. 4 is a timing chart for illustrating the generating method of the pseudo BD signal in Embodiment 1.
Figure 5:
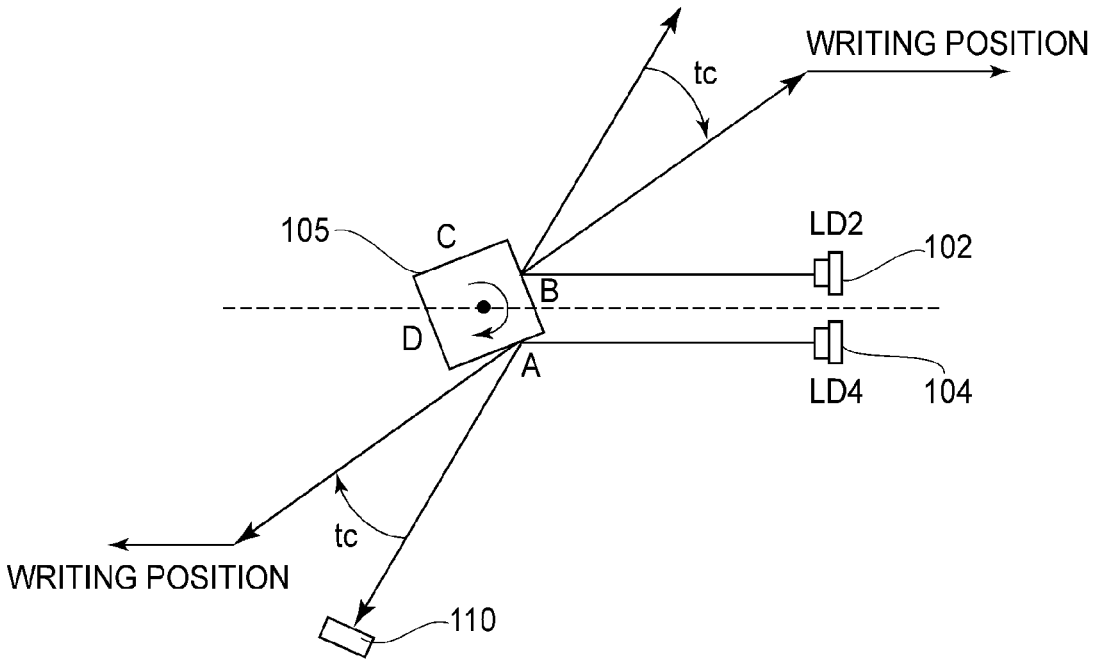
FIG. 5 is a schematic view showing a relation between a polygonal mirror, laser diodes and a BD sensor in Embodiment 1.

In the case of the BD signal 401, the pseudo BD signal 404 as shown in FIG. 4 is generated. In this way, the signal (pseudo BD signal), other than the BD signal, to be outputted at timing different from the output timing of the BD signal is generated. Incidentally, the signal other than the BD signal refers to a signal, to be outputted timing different from the output timing of the BD signal before the correction is made, which is at least one of the BD signals sent during one turn (rotation) of the polygonal mirror 105 (i.e., the BD signals outputted four times in total for the four sides in this embodiment). That is, as in the case of the above-described pseudo BD signal, if at least one side provides the correction value of 0 as when the pseudo BD signal is outputted on the basis of the BD signal for one of the A side, the C side and the D side, the signal constitutes the signal other than the BD signal even when the case where the correction value is 0 as in the case where the pseudo BD signal is outputted on the basis of the BD signal for the B side is included.

A series of process operations of the pseudo BD signal generation is as described above.

Here, in the case, the reference side is determined by determining that the polygonal mirror side having the smallest (shortest) BD period provides the correction value of 0, but the present invention is not limited thereto. However, in this embodiment, in order to further enhance accuracy of the timing of the pseudo BD signal, the polygonal mirror side having the smallest BD period is determined as the side where the correction value is 0. By determining the polygonal mirror side having the smallest BD period as the side where the correction value is 0, the above-described correction values (xa−xb), (xc−xb) and (xd−xb) can be made positive (values). For example, in the case where the correction value (xc−xb) is a negative value, the generation of the pseudo BD signal for the D side is not in time if the BD signal for the C side has already been sent, and therefore there is a need to generate the pseudo BD signal for the D side by adding a positive correction value to the timing of the BD signal for the B side. However, in the generation of the pseudo BD signal for the D side, when the BD signal for the B side is used as a reference, compared with the case where the BD signal for the C side is used as the reference, the BD signal for the immediately preceding side of the C side. Therefore, the correction value becomes large, so that there is a fear that the accuracy is lowered.

Next, a characteristic feature of this embodiment will be described.

In this embodiment, a constitution in which the yellow image is formed on the basis of the BD signal and then subsequent magenta, cyan and black images are subjected to image registration (alignment) in the main scan direction on the basis of the pseudo BD signal is employed. In such a constitution, this embodiment is characterized in that the yellow image formation is started before completion of the correction value calculation for the pseudo BD signal (before start of output of the pseudo BD signal, i.e., in a period in which the step of deriving the correction value by the second signal output means is executed). Here, the image formation start for each of the colors means start of the electrostatic latent image formation on the photosensitive drum.

By employing such a constitution, it becomes possible to reduce the first print out time in a full-color mode. Here, the yellow image formation corresponds to the image formation on the first image bearing member. Further, before completion of the correction value calculation for the pseudo BD signal refers to before the correction value calculation by the CPU 403 performed by using the value of the BD period calculated by the above-described ASIC 402 is completed.

Parts (A) and (B) of FIG. 6 are timing charts for illustrating the feature of this embodiment, in which (A) of FIG. 6 shows timing in the case where the yellow image formation is started after the completion of the correction value calculation for the pseudo BD signal as in a conventional constitution, and (B) of FIG. 6 shows timing in the case where the yellow image formation is started before the completion of the correction value calculation for the pseudo BD signal as in this embodiment.

The time required for calculating the correction value for the pseudo BD signal is sufficiently shorter than a time between the first image formation timing and the second image formation timing, and therefore the calculation of the correction value for the pseudo BD signal is completed at the timing when the magenta image formation is started. By using the pseudo BD signal obtained by the correction, the magenta image formation is effected. In FIG. 6, the abscissa represents lapse of time from start of printing, and the ordinate represents processes sequentially performed by the printer. Further, in (A) and (B) of FIG. 6, the number and required times of respective elements or steps are the same.

First, the processes in (A) of FIG. 6 will be described.

First, a scanner motor and a fixing device are activated (T100), and then rise of a high-voltage source (power source) is made (T101). The rise of the high-voltage source means that voltages and currents of high-voltage sources four steps of charging, development and transfer necessary for the electrophotographic process are controlled so as to become target values.

When the activation and rise end, calculation of a correction value for the pseudo BD signal is started (T102). After the calculation of the correction value for the pseudo BD signal is completed (T103), formation and primary transfer of images of four colors of yellow (Y), magenta (M), cyan (C) and black (BK) are started. In this case, the image formation is effected by using the pseudo BD signal 404 generated on the basis of the calculated correction value and the BD signal 401 sent from the BD sensor 110. Here, in order to generate the pseudo BD signals for magenta, cyan and black even after the yellow image formation is ended, control such that the light is emitted from the laser diode LD4 only at timing when the BD signal 401 is capable of being outputted (unblanking control). That is, the laser diode LD4 is caused to emit the light by estimating timing when the light enters the BD sensor 110.

When this process is ended, secondary transfer for transferring the toner images (developer images) from the intermediary transfer belt 211 onto the recording material is made (T104). Thereafter, on the recording material on which the toner images are transferred, the toner images are fixed as a permanent image by the fixing device 313 controlled at a target temperature (T105). When the fixing is ended, the recording material is discharged onto the discharge tray (T106), and thus the image formation is ended (T107).

In the processes in (B) of FIG. 6, compared with those in (A) of FIG. 6, yellow image formation start timing is different. The yellow image formation start timing is the timing (T103) of the completion of the calculation of the correction value for the pseudo BD signal in (A) of FIG. 6, whereas the yellow image formation start timing is the same execution timing (T202) as the timing of calculation start of the correction value for the pseudo BD signal 404 in (B) of FIG. 6. This timing (T202) is not calculation completion timing (T203) of the correction value for the pseudo BD signal. Subsequent control processes (steps) including the image formation, the primary transfer, the secondary transfer, the fixing and the discharge (T204 to T207) in (B) of FIG. 6 are the same as those in (A) of FIG. 6, and therefore will be omitted from description.

The first print out time is a time from start of printing until the recording material is discharged to the outside of the printer (i.e., a time from reception of print request to the discharge of the recording material to the outside of the printer).

The first print out time in the case where the yellow image formation is started after the calculation of the correction value for the pseudo BD signal is completed is from T100 to T107 ((A) of FIG. 6). On the other hand, the first print out time in the case where the yellow image formation is started before the calculation of the correction value for the pseudo BD signal is completed is from T200 to T207 ((B) of FIG. 6). It is understood that the first print out time (from T200 to T207) in (B) of FIG. 6 is, when compared with the first print out time (from T100 to T107) in (A) of FIG. 6), shortened by a time (Ts in FIG. 6) required for calculating the correction value for the pseudo BD signal.

FIG. 7 is a flowchart showing a flow (of a procedure) carried out by the engine controller 204 in this embodiment when the engine controller 204 receives a print instruction (command) from the video controller 203.

First, the engine controller 204 activates the scanner motor (S101). Thereafter, the engine controller 204 discriminates whether or not the number of turns (rotations) of the scanner motor reaches a predetermined number of turns (S102). In the following description, a state in which the number of turns of the scanner motor reaches the predetermined number of turns is referred to as scanner ready (state). When the scanner motor is placed in the scanner ready state, the calculation of the correction value for the pseudo BD signal is started and at the same time, the yellow image formation is started (S103 and S104).

In the case where the calculation of the BD period and the calculation of the correction value for the pseudo BD signal are completed until the magenta image formation start timing, the magenta image formation is started (S105 and S106). The pseudo BD signal is outputted immediately after the completion of the correction value calculation. Thereafter, at predetermined image formation start timing, cyan image formation and black image formation are effected, so that a color image is formed (S108 to S111). Here, a state in which the calculation of the BD period and the calculation of the correction value for the pseudo BD signal are completed is referred to as pseudo BD ready (state).

Further, the flow carried out by the engine controller 204 in this embodiment includes a flow ready for the case of abnormal circumstances in which the output of the pseudo BD signal cannot be started due to an improper operation or the like of the ASIC 402. This case will be described.

In the case where the pseudo BD ready is not realized until magenta image formation start timing, pseudo BD error handling (clearance) is made (S112). In the error handling, a result (correction value) when the correction value for the preceding pseudo BD signal is calculated is stored in a storing means, and then the value may be used as the correction value or alternatively a predetermined value of, e.g., 0 may also be used as the correction value for the pseudo BD signal.

This is based on discrimination that although image registration (alignment) accuracy with respect to the main scan direction is inferior to that during the pseudo BD ready due to improper calculation of the correction value for the pseudo BD signal, the image formation is continued based on priority on shortening of the first print out time. At that time, a user may be urged to pay attention by providing notification of warning to a display panel or the host computer.

Incidentally, the discrimination as to whether or not the pseudo BD ready is realized (S106) may only be required that the discrimination is made before the cyan image formation in which the latent image is formed on the basis of the pseudo BD signal is started. That is, in the flowchart of FIG. 7, the procedure may also be modified so that the discrimination as to the pseudo BD ready (S106) is made between the magenta image formation start (S107) and the cyan image formation start (S109). In this embodiment, the reason why the discrimination as to the pseudo BD ready is made between the yellow image formation start (S104) and the magenta image formation start (S107) is that the ASIC 402 in this embodiment usually has a performance such that the calculation of the correction value for the pseudo BD signal can be completed before the magenta image formation start.

As described above, in this embodiment, in the constitution in which the yellow toner image is formed on the basis of the BD signal and then the toner images of magenta, cyan and black are registered (aligned) with the yellow toner image with respect to the main scan direction on the basis of the pseudo BD signal, the yellow image formation is started before the completion of the calculation of the correction value for the pseudo BD signal and before start of output of the pseudo BD signal. As a result, it becomes possible to shorten the first print out time in an operation in a full-color mode.

Here, in this embodiment, the shortening of the first print out time in the image formation on the recording material was described. However, the constitution in this embodiment is also effective for the purpose of color misregistration correction in the case where the image is formed on the intermediary transfer belt 211, and thus is not limited to the image formation on the recording material. Further, the example of the polygonal mirror having the four sides was shown. However, the constitution in this embodiment is also effective with respect to polygonal mirrors having three five and more sides, and therefore is not limited to the polygonal mirror having the four sides.

Embodiment 2

Embodiment 2 will be described. In this embodiment, a constitution portion different from that in Embodiment 1 will be described, and a constitution portion similar to that in Embodiment 1 will be omitted from description.

FIG. 8 is a schematic perspective view for illustrating a scanner unit in this embodiment.

In Embodiment 1, the BD sensor 110 was disposed correspondingly to the image formation for the first color in which the light is emitted from the laser diode LD4, but this embodiment is characterized in that the BD sensor 110 is disposed correspondingly to image formation for the second color in which the light is emitted from the laser diode LD3. The order of the colors during the image formation is the same as in Embodiment 1, and thus the first color is yellow and the second color is magenta.

In the following, a relation between the image formation start and the scanner motor activation in this embodiment will be described. Usually, when the photosensitive drum is exposed to and scanned with laser light during the activation of the scanner motor, an exposed portion is not electrically charged sufficiently in a charging step, so that a charged state of the photosensitive drum is not uniform, and therefore there is a need to wait for a predetermined time in order to form the image on the photosensitive drum.

Therefore, in this embodiment, a constitution in which the photosensitive drum for the second color is exposed to and scanned with the laser light, during the activation of the scanner motor, emitted from the laser diode LD3, not the laser diode LD4 for the first color is employed. As a result, the photosensitive drum for the first color is prevented from being exposed to the laser light during the activation of the scanner motor, and therefore the image formation for the first color can be started in a state in which the photosensitive drum is electrically charged uniformly. Further, also with respect to the photosensitive drum for the second color exposed to the laser light emitted during the scanner motor activation, at the image formation start timing for the second color, a sufficient time in which the photosensitive drum is electrically charged uniformly elapses, and therefore, good image formation can be effected.

The laser diodes LD4 and LD3 form the electrostatic latent images by emitting light beams on the basis of the first horizontal synchronizing signal outputted from the BD sensor 110 having received the light from the laser diode LD3. The laser diodes LD2 and LD1 form the electrostatic latent images by emitting light beams on the basis of the second horizontal synchronizing signal generated on the basis of the first horizontal synchronizing signal and the correction value.

An operation thereof will be described specifically below.

FIG. 9 is a flowchart showing a flow (of a procedure) carried out by the engine controller 204 in this embodiment when the engine controller 204 receives a print instruction (command) from the video controller 203.

The engine controller 204 activates, when printing is started, the scanner motor (S201). Thereafter, the engine controller 204 discriminate whether or not the number of turns (rotations) of the scanner motor reaches a predetermined number of turns (S202). After confirming that the scanner motor is placed in the scanner ready state, the calculation of the correction value for the pseudo BD signal and, the yellow image formation are started (S203 and S204).

With respect to the magenta, image formation using the BD signal is made, and therefore image formation is started at the magenta image formation timing (S205 and S206).

In the case where the calculation of the correction value for the pseudo BD signal is completed until the subsequent cyan image formation start timing, control of steps S207 and S211 is effected. That is, the correction value for the pseudo BD signal is stored, and at the same time, the cyan image formation is started (S207 and S209). Thereafter, at black image formation start timing, black image formation is effected to form a color image (S210 and S211).

The process in the case where the calculation of the correction value for the pseudo BD signal is not completed is the same as that in Embodiment 1, and therefore will be omitted from description.

As described above, in this embodiment, in the constitution in which the magenta toner image is formed on the basis of the BD signal and then the toner images of yellow, cyan and black are registered (aligned) with the yellow toner image with respect to the main scan direction on the basis of the pseudo BD signal, the yellow image formation is started before the completion of the calculation of the correction value for the pseudo BD signal. As a result, waiting of charging state restoration of the photosensitive drum due to the light emission during the actuation of the motor is avoided, and the image formation of the first color (yellow), so that the first printout time can be shortened.

Embodiment 3

Embodiment 3 will be described. In this embodiment, a constitution portion different from that in Embodiment 1 will be described, and a constitution portion similar to that in Embodiment 1 will be omitted from description.

FIG. 10 is a sectional view showing a general structure of an image forming apparatus in this embodiment.

In Embodiment 1, the case of the single scanner unit was described, whereas in this embodiment, a constitution in which two scanner units are mounted will be described.

In this embodiment, as shown in FIG. 10, a constitution in which the images of the first and second colors are formed by using a scanner unit 216 and the images of the third and fourth colors are formed busing a scanner unit 215 is employed. In the scanner unit 216, a light source group for the laser diodes LD3 and LD4 and a polygonal mirror 116 are provided. In the scanner unit 215, a light source group for the laser diodes LD1 and LD2 and a polygonal mirror 115 are provided. Further, BD signals are provided correspondingly to image formation of the first and third colors. With respect to the second color, the pseudo BD signal is generated on the basis of output of the BD sensor for the first color, and with respect to the fourth color, the pseudo BD signal is generated on the basis of output of the BD signal for the third color.

FIG. 11 is a block diagram for illustrating a generating method of the pseudo BD signal.

Here, the generation of the pseudo BD signal in the scanner unit 216 will be described. With respect to the generation of the pseudo BD signal in the scanner unit 215, the generating method is similar to that in the scanner unit 216.

A BD signal 412 as a horizontal synchronizing signal from a BD sensor 112 is connected with the engine controller 204. The ASIC 402 receives the BD signal 412 and then calculates a value of a BD period, and thereafter sends the calculated BD signal 412 to the CPU 403. The CPU 403 calculates, from the value of the BD period, a correction value for generating a pseudo BD signal, and then inputs the correction value into the ASIC 402 through an address data bus. Further, the ASIC 402 generates a pseudo BD signal 416 from the correction value and the BD signal 412 outputted from the BD sensor 112.

The video controller 203 receives the BD signal 412 outputted from the BD signal 112 and the pseudo BD signal 416 generated by the ASIC 402. Further, at predetermined timing after the detection of the BD sensor 112, image data VDOM and VDOY are outputted from the video controller 203 to the laser diodes LD3 and LD4 of the scanner unit 216.

By employing such a constitution, even in a constitution in which a plurality of scanner units are provided, similarly as in Embodiment 1, by starting the image formation before the completion of the calculation of the correction value for the pseudo BD signal, it is possible to shorten the first print out time while ensuring accuracy of image registration (alignment).

The above operation will be described specifically below.

FIG. 12 is a flowchart showing a flow (of a procedure) carried out by the engine controller 204 in this embodiment. The scanner units 215 and 216 are independently operated, and therefore a difference from Embodiment 1 is that the image formation is effected after confirming the scanner ready (state) and the pseudo BD ready (state) with respect to each scanner unit. The flow will be described specifically below.

The engine controller 204 activates, when printing is started, an unshown scanner motor mounted in each of the scanner units 215 and 216 (S301). First, the engine controller 204 discriminates whether or not the number of turns (rotations) of the scanner motor for the scanner unit 216 reaches a predetermined number of turns (S302). When the scanner motor for the scanner unit is 216 is placed in the scanner ready state, the calculation of the correction value for the pseudo BD signal 416 is started and at the same time, the yellow image formation is started (S303 and S304).

In the case where the calculation of the correction value for the pseudo BD signal 416 is completed until the magenta image formation start timing, the magenta image formation is started (S305 to S307). On the other hand, in the case where the engine controller 204 discriminates that the scanner unit 216 is not in the pseudo BD ready state, pseudo BD error handling (clearance) is made (S315). The pseudo BD error handling is the same as that in Embodiment 1, and therefore will be omitted from description.

Then, at timing when the scanner unit 215 is in the scanner ready state, the calculation of the correction value for a pseudo BD signal 415 is started, and at the same time, the cyan image formation is started (S308 to S311). In the case where the scanner unit 215 is not in the scanner ready state, scanner motor activation abnormality handling (clearance) is effected (S308 and S316). In the scanner motor activation abnormality handling, the image forming position is stopped immediately, and then a message to the effect that the scanner motor is out of order is displayed on the display panel provided on the printer or is notified to the host computer connected with the printer.

Next, in the case where the calculation of the correction value for the pseudo BD signal 415 is completed until the black image formation start timing, the black image formation is started (S312 to S314).

By the above processes, the color image is formed.

As described above, in this embodiment, in the constitution in which the two scanner units are provided and with respect to each scanner unit, image registration (alignment) with respect to the main scan direction is carried out by using the BD signal and the pseudo BD signal, the yellow image formation is started every scanner unit before the completion of the calculation of the correction value for the pseudo BD signal. As a result, it becomes possible to shorten the first print out time.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 272832/2012 filed Dec. 13, 2012 and 251891/2013 filed Dec. 5, 2013, which are hereby incorporated by reference.

What is claimed is:

1. An image forming apparatus for starting image formation on the basis of a print command, comprising:

first and second light sources each for emitting light according to image data;

a rotatable polygonal mirror including a plurality of reflecting facets, wherein said rotatable polygonal mirror deflects the light emitted from said first light source toward a first photosensitive member and deflects the light emitted from said second light source toward a second photosensitive member;

a first signal output unit for outputting a first signal by receiving, in a predetermined position, the light emitted from said first light source and deflected by said rotatable polygonal mirror; and a second signal output unit for outputting a second signal at timing on the basis of the first signal and a correction value, wherein the correction value is set for each reflecting facet of said rotatable polygonal mirror, wherein said first light source emits the light according to the image data based on a time when the first signal is outputted and said second light source emits the light according to the image data based on a time when the second signal is outputted so that latent images are formed on the first and second photosensitive members, respectively, wherein said second signal output unit starts the output of the second signal after a lapse of a predetermined period from start of the output of the first signal by said first signal output unit after said image forming apparatus receives the print command, and wherein after said image forming apparatus receives the print command and before the output of the second signal is started, said first light source starts light emission according to the image data.

2. An image forming apparatus according to claim 1, wherein the light emitted from said first light source and the light emitted from said second light source at the same timing are incident on different reflecting facets of said rotational polygonal mirror to illuminate the first and second photosensitive members therewith, respectively.

3. An image forming apparatus according to claim 1, further comprising:

a belt contactable to the first and second photosensitive members, wherein with respect to a movement direction of a surface of said belt, a contact portion between the first photosensitive member and said belt is provided upstream of a contact portion between the second photosensitive member and said belt.

4. An image forming apparatus according to claim 3, wherein the latent images formed on the first and second photosensitive members, respectively, are developed with developers to form developer images, and wherein the developer images are superposedly transferred from said first and second photosensitive members onto said belt.

5. An image forming apparatus according to claim 3, wherein the latent images formed on the first and second photosensitive members, respectively, are developed with developers to form developer images, and wherein the developer images are superposedly transferred from the first and second photosensitive members onto a recording material conveyed on said belt.

6. An image forming apparatus according to claim 1, wherein in the predetermined period, said second signal output unit derives the correction value, for correcting the first signal for each reflecting facet of said rotational polygonal mirror, and then generates and outputs the second signal for each reflecting facet of said rotational polygonal mirror on the basis of the correction value and the first signal, and wherein in a period in which a step of deriving the correction value by said second signal output unit is executed, said first light source starts light emission on the basis of the first signal to form the latent image on the first photosensitive member.

7. An image forming apparatus according to claim 6, wherein the step of deriving the correction value by said second signal output unit includes a step of deriving the correction value on the basis of an interval between adjacent first signals outputted for each reflecting facet of said rotatable polygonal mirror.

8. An image forming apparatus according to claim 1, wherein the latent image formed on the first photosensitive member is developed with a yellow developer.

9. An image forming apparatus according to claim 1, wherein the latent image formed on the first photosensitive member is developed with a magenta developer.

10. An image forming apparatus according to claim 1, wherein the first signal is outputted for each reflecting facet of said rotatable polygonal mirror by said first signal output unit, and the second signal is outputted for each reflecting facet of said rotatable polygonal mirror by said second signal output unit.

11. An image forming apparatus according to claim 1, wherein a latent image formation position is determined, with respect to a main scan direction, when the latent image is formed on the first photosensitive member by the light emission of said first light source after a lapse of the predetermined period from the output of the first signal, and is determined, with respect to the main scan direction, when the latent image is formed on the second photosensitive member by the light emission of said second light source after a lapse of a predetermined period from the output of the second signal.

* * * * *